US011974685B2

(12) United States Patent
Crawford

(10) Patent No.: US 11,974,685 B2
(45) Date of Patent: May 7, 2024

(54) SMART DEVICE FOR RETAINING PLANAR ITEMS

(71) Applicant: Camie Amber Crawford, Meridian, ID (US)

(72) Inventor: Camie Amber Crawford, Meridian, ID (US)

( * ) Notice: Subject to any disclaimer, the term of this patent is extended or adjusted under 35 U.S.C. 154(b) by 355 days.

(21) Appl. No.: 17/250,994

(22) PCT Filed: Oct. 8, 2019

(86) PCT No.: PCT/US2019/055266

§ 371 (c)(1),
(2) Date: Apr. 8, 2021

(87) PCT Pub. No.: WO2020/081304

PCT Pub. Date: Apr. 23, 2020

(65) Prior Publication Data

US 2022/0279953 A1 Sep. 8, 2022

(30) Foreign Application Priority Data

Oct. 8, 2018 (GB) ..... 1816405

(51) Int. Cl.
*A47G 29/122* (2006.01)

(52) U.S. Cl.
CPC .. *A47G 29/1225* (2013.01); *A47G 2029/1226* (2013.01)

(58) Field of Classification Search
CPC ..... A47G 29/1225; A47G 29/1207; A47G 29/1223; A47G 29/122; A47G 29/16; A47G 29/30; A47G 29/12; A47G 29/00; A47G 2029/1226; A47G 2029/1228
USPC ..... 232/33
See application file for complete search history.

(56) References Cited

U.S. PATENT DOCUMENTS 1,027,524 A * 5/1912 Cook ..... A47G 29/1207 383/22
1,368,868 A * 2/1921 Wertman ..... A47G 29/1203 24/511
1,797,961 A * 3/1931 Mcbride ..... B65D 29/00 383/33
1,810,769 A * 6/1931 Jaden ..... A47G 29/12 232/28

(Continued)

FOREIGN PATENT DOCUMENTS

DE 29809756 U1 9/1998
GB 2572137 A 9/2019

OTHER PUBLICATIONS

PCT International Search Report and the Written Opinion for Application No. PCT/US19/55266, dated Jan. 9, 2020, 4 pgs.

*Primary Examiner* — William L Miller
(74) *Attorney, Agent, or Firm* — SUPERIOR IP, PLLC; Dustin L. Call

(57) ABSTRACT

An apparatus comprising: a retaining device for retaining planar items including mail and/or documents, in which mail can be located and from which mail can be collected; a control means; a sensor means for indicating to the control means information indicative of mail and/or documents having been placed in the retaining device and/or removed from the retaining device, wherein the control means is arranged to cause, in response thereto, at least one action to be performed.

16 Claims, 6 Drawing Sheets

(56) References Cited

U.S. PATENT DOCUMENTS 1,828,417 A * 10/1931 Keleher ..... A47G 29/12 24/67.3
2,068,275 A * 1/1937 William ..... A47G 29/1209 232/33
2,092,681 A * 9/1937 Reilly ..... A47G 29/1203 24/563
2,642,191 A * 6/1953 Lawrence ..... A47G 29/08 211/89.01
2,829,820 A * 4/1958 Evers ..... A47G 29/1223 232/19
3,263,352 A * 8/1966 Fitzpatrick ..... A47G 29/1209 40/1.5
3,515,337 A * 6/1970 Bornus ..... A47G 29/1209 232/33
3,762,632 A * 10/1973 Voegeli ..... A47G 29/1203 232/33
4,548,376 A 10/1985 DeGore
5,323,959 A * 6/1994 Draper ..... A47G 29/122 232/29
6,462,659 B1 10/2002 Schuette
6,831,558 B1 12/2004 Andrew
7,240,823 B1 * 7/2007 Saidiazar ..... A47G 29/12 232/19
7,256,691 B2 8/2007 Awobue
7,398,915 B1 7/2008 Pineda-Sanchez et al.
7,486,948 B1 2/2009 Vergon
9,336,667 B2 5/2016 Hammoud
10,016,083 B1 7/2018 Atieh
10,076,204 B1 9/2018 Sadeghi
10,682,002 B2 * 6/2020 Miller ..... A47G 29/20
11,406,212 B2 * 8/2022 Odeh ..... A47G 29/141
11,412,876 B1 * 8/2022 Kadlub ..... A47G 29/20
2002/0070269 A1 * 6/2002 Rosiello ..... A47G 29/12 232/19
2005/0104730 A1 5/2005 Yang
2005/0122220 A1 6/2005 Staples
2006/0083359 A1 4/2006 Mukunya
2008/0040243 A1 2/2008 Chang et al.
2009/0184159 A1 7/2009 Crawford
2013/0034273 A1 2/2013 Mardirossian
2013/0147626 A1 6/2013 Hammoud
2016/0051073 A1 2/2016 Heinz et al.
2016/0241660 A1 8/2016 Nhu
2019/0223644 A1 * 7/2019 Hopp ..... A47G 29/20
2022/0333733 A1 * 10/2022 Crawford ..... F16M 13/02

* cited by examiner

SMART DEVICE FOR RETAINING PLANAR ITEMS

This Application claims priority to PCT/US2019/055266, filed Oct. 8, 2019, which claims priority to United Kingdom Patent Application Serial No. 1816405.3 filed on Oct. 8, 2018, the contents of each of which is incorporated herein by reference.

FIELD OF THE INVENTION

The invention relates to a device for retaining planar items and for performing an action when such planar items are added to and/or removed from the device. The planar items may include but are not limited to mail and/or documents. The invention also relates to a related method.

BACKGROUND OF THE INVENTION

It may be wanted to leave mail for collection. In some regions, mail is collected from predetermined locations, such as homes, as well as delivered. Often no place is provided for a person to leave their mail for collection. It is an object of the present invention to facilitate collection of mail and also improve generally upon conventional mail holders.

SUMMARY OF THE INVENTION

According to a first aspect of the present invention, there is provided an apparatus comprising: a retaining device for retaining planar items including mail, in which mail can be placed and from which mail can be collected; a control means; a sensor means for indicating to the control means information indicative of such planar items having been placed in the retaining device and/or removed from the retaining device, wherein the control means is arranged to cause, in response thereto, at least one action to be performed. Documents may be retained additionally or alternatively to mail.

The apparatus may further comprise attaching means, wherein the retaining device is configured for mounting on a vertical mounting surface using the attaching means.

The sensor means may be configured to indicate to the control means when mail has been removed from and/or placed in the mail retainer by indicating presence and/or absence of mail in the mail retainer. The sensor means may be configured to indicate to the control means when mail has been removed from the mail retainer by indicating when a person or a smart object, such as a robot, is present at or near the mail retainer. By way of examples, the sensor means may comprise at least one of: a motion detector arranged to indicate to the control means removal of mail from and/or placing of mail in the mail retainer, or a person or a smart object at or near the mail retainer; a flex sensor configured to indicate to the control means movement of the second portion relative to the first portion; a pressure sensor arranged on the mail retainer to indicate to the control means presence and/or absence of mail in the retainer; an optical sensor arranged to indicate presence and/or absence of mail in the mail retainer to the control means; and/or a weight sensor arranged on the mail retainer to indicate to the control means presence and/or absence of mail by identifying the difference in weight of the contents of the retainer.

The at least one action may be performed by at least one action unit. The at least one action unit may comprise means for capturing an image and/or video (with or without audio) and/or playing of a live stream of the person or smart object removing and/or adding mail, wherein the at least one action comprises capturing the image and/or video, and sending and/or transferring the image and/or video. The at least one action unit may, additionally or alternatively, comprise a memory means and a speaker coupled to the control means, wherein the at least one action comprises playing of an audio file stored on the memory means using the speaker. Alternatively, at least one action unit may comprise a display means coupled to the control means, wherein the at least one action may comprise causing a stored or live video to be played on a display means.

The sensor means may be a motion detector, as mentioned above, including image and/or video (with or without audio) capture means, wherein the image and/or video capture means is configured to capture an image and/or video of the person or of a smart object removing and/or adding mail and provide the image and/or video to the control means, wherein the at least one action comprises sending or transferring the image and/or video.

The apparatus may include a communications unit coupled to the control means. The control means may be configured to indicate to a smart hub or connected device whether mail is present or absent in the retaining device, or whether mail has been added or removed. Such a device may be used individually or part of a smart home and/or smart office system and/or network of devices with an integrated software application that allows users to monitor the mail activities of and around the retainer.

Where the at least one action unit comprises the memory means and the speaker, the apparatus may further comprise a microphone and a user control coupled to the control means wherein the user control and the microphone are operable to record the audio file, wherein the control means stores the audio file on the memory means.

The retaining device may comprise: first and second portions; a base, a respective edge of each item of mail being locatable on the base between the first and second portions. The first and second portions preferably extend upwardly in use, such that the planar items rest on the base. The second portion may be arranged to press respective sides of retained items against the first portion and to be moveable away from the first portion to release retained items.

According to a second aspect of the present invention, there is provided a method comprising: receiving at a control means information indicative of mail and/or documents having been removed from and/or added to a retainer for mail and/or documents; in response thereto, causing at least one action to be performed.

The causing the at least one action to be performed may comprise causing a stored audio message to be output by a speaker. The at least one action may alternatively comprise causing a stored video to be played on a display means and/or for an image and/or video (with or without audio) to be captured of the person or smart object removing the mail. Additionally, the video and/or image capture may be engaged when adding mail and/or when in the vicinity of the device and/or when set to record at continuous intervals.

The receiving may comprise receiving the information from a sensor means in response to the mail being removed from, and/or added to, the mail retainer.

The mail may be retained in the mail retainer by a second portion pressing against a first portion, wherein the second portion moving from a first position relative to the first portion to a second position relative to the first portion causes the sensor to send said information to the control means. The first position may be nearer the first portion than the second position and/or further away from the first portion than the second position.

According to a third aspect of the present invention, there is provided apparatus comprising: a retainer for retaining mail items comprising first and second portions and a base, a respective edge of each item being locatable on the base between the first and second portions, the second portion being arranged to press respective sides of retained items against the first portion and to be moveable away from the first portion to release retained items; and attaching means for attaching the retainer to a fixed object.

The apparatus may further comprise an electronic device used individually or as part of a smart home and/or smart office system and/or network of devices with an integrated software application that allows users to monitor the mail activities of and around the retainer.

Mail may be conveniently located in the mail retainer and removed from it. Where mail is a conventional size, the mail retainer enables a person or a smart object, for example a robot, collecting mail to determine from a distance whether any mail is there to be collected. Additionally, the presence or the absence of the device itself may act as a visual indicator for the person or smart object.

The attaching means may be for detachably attaching the retainer to the fixed object. For example, hook and loop (i.e. Velcro®), interlocking components (i.e. Dual Lock™), snaps, buttons, and/or other fasteners. Alternatively, the attaching means may enable the retainer to be fixedly attached to the fixed object, for example by a screw or nail or permanent adhesive.

The first and second portions and the base may be formed of a single piece of material, wherein the material is resiliently deformable, such that the second portion is moveable away from the first portion to release retained items by flexing of the material.

The retainer may further comprise a parting portion extending from the second portion, wherein the parting portion is operable under finger pressure to flex the second portion away from the first portion. The parting portion may be formed of the single piece of material.

The first and second portions and the base may be formed of at least two parts attached together. The first and second portions, the base and the parting portion may be formed of at least two parts attached together.

The attachment means may comprise a flexible or rigid strap means arranged such that the retainer can be hung by the attachment means from the fixed object.

The attachment means may comprise first and second attachment portions. In this case, the first attachment portion is attachable to the fixed object, the second attachment portion is attached to the first portion or the base, and the first attachment portion and the second attachment portion are arranged to detachably attach together.

One of the first and second attachment portions may comprise the strap means. The first and second attachment portions may each comprise material that enables attachment and detachment. For example, hook and loop (i.e. Velcro®), interlocking components (i.e. Dual Lock™), snaps, buttons, and/or other fasteners.

The first attachment portion may comprise the strap means and first and second ends coupled by the strap means, wherein the first end is attachable to the fixed object.

The first end of the first attachment portion may include a first part fixedly attached to the fixed object, for example with adhesive, and a second part, wherein the first part and the second part are arranged to detachably attach and the second part is attached to the first end. For example the first and second parts may comprise a hook and loop material enabling attachment and detachment.

The second attachment portion may comprise first and second ends and the strap means, wherein the strap means couples the first and second ends, wherein the first end and the first attachment portion are detachably attached, and the second end is attached to the device.

The fixed object may be a door or wall having an aperture, and the attachment means is arranged to attach to an interior side of the door or wall, and wherein the strap means is arranged to extend through the aperture, and the retainer is at least partially supported by the strap means at an exterior of the door or wall.

The base may have a cutout therein to allow dirt and liquid to fall through. The cutout may also facilitate the flex tension for opening the device.

The mail retainer may be shaped such that retained mail extends from sides of the second portion, such that retained mail is visible from a distance. Additionally, it may be shaped to be compact, non-protrusive, and non-obtrusive (for example, to easily reside within the trim of a door).

The control means of the system may perform at least one action when retained items are removed from and/or placed in the mail retainer. Additionally, the control means may perform at least one action when there is motion within the vicinity of the device and/or when set to record at particular intervals, as dictated by the user.

The performing the at least one action comprises causing the image and/or video (with or without audio) capturing means of the system to capture and provide images and/or videos of a person or smart object collecting the mail and/or the user adding mail and/or of a person or smart object within vicinity of the retainer, and to store in the storage means and/or send to a server or user device the captured images and/or videos using communication means.

The system comprising means for playing a stored audio message, wherein the causing the at least one action to be performed comprises causing the audio output means for playing the stored audio message to play the message. Additionally, the audio message may be reprogrammable by the user.

The system may comprise a global positioning system (GPS) or other global satellite navigation system (GNSS), configured to provide real time location of the retainer if the system is removed from an originally installed location.

The means for indicating may comprise motion detection apparatus, wherein the indicating when retained items are removed from and/or placed in the mail retainer comprises the motion detection apparatus providing information indicative of the retained items having been removed to the control means.

The means for indicating when items have been removed from and/or added to the mail retainer may comprise a sensor means configured to provide a signal to the control means in response to the second portion moving relative to the first portion.

The base of the retainer may have a cutout therein. This facilitates flexing of the second portion relative to the second portion, as well as drainage of rain water and snow and/or dirt.

There may be provided an assembly comprising: the apparatus described above with the presence and/or absence of the some or any of the apparatus; and a bag having at least one handle, wherein the at least one handle is attached to the mail retainer.

There may be provided an assembly comprising: the apparatus described above with the presence and/or absence of the some or any of the apparatus; a mail catching means located on a side of a door or wall at which mail is received through the mailing aperture, wherein the mail catching means includes a portion to which the attachment means is configured to attach.

According to a fourth aspect of the present invention, there is provided a method of attaching a mail retainer to a fixed object having a mailing aperture therein, comprising: attaching a mail retainer to a first end of a strap means at a first side of the mailing aperture; placing the strap means through the mailing aperture such that mailing through the mailing aperture is not prevented; attaching a second end of the strap means to a first surface at a second side of the mailing aperture using an attachment means.

The attachment means may comprise hook and loop material (i.e. Velcro®), interlocking components (i.e. Dual Lock™), snaps, buttons, and/or other fasteners. The method may further comprise attaching the mail retainer to a second surface at a second side of the mailing aperture.

BRIEF DESCRIPTION OF FIGURES

For better understanding of the present invention, embodiments will now be described, by way of example only, with reference to the accompanying Figures in which.

DETAILED DESCRIPTION OF EMBODIMENTS

Embodiments of the invention relate to a mail retaining system. The system may be attached to a substantially vertical mounting surface, for example a door or a wall. Certain description herein, such as "vertical", "horizontal" and "downwardly", for example, relates to orientation when parts are in use and should not be construed in a limiting manner.

While embodiments are intended for use with mail, they are not limited to such. The system may be used with other planar objects of similar size to mail. Typically, the mail retainer is intended for use with planar items such as mail ranging in length from about 5 inches (about 12.5 cm) to about 12 inches (about 30 cm) and about 3 inches (about 3.5 cm) to about 7 inches (about 18 cm) in height. The word "mail" should also be considered to include "packages" of less than about two inches (about 5 cm) in thickness. The mail retainer may be used with mail that has one or more dimensions that are greater or lesser than those indicated above.

Figure 1A:
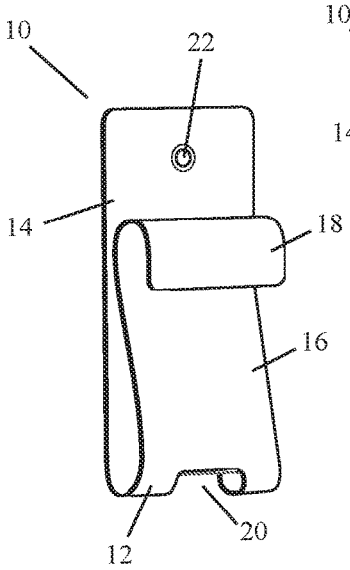
FIGS. 1A-1D are respectively perspective, front, back and side views of a device for facilitating mail collection in accordance with an embodiment of the invention.
Figure 1B:
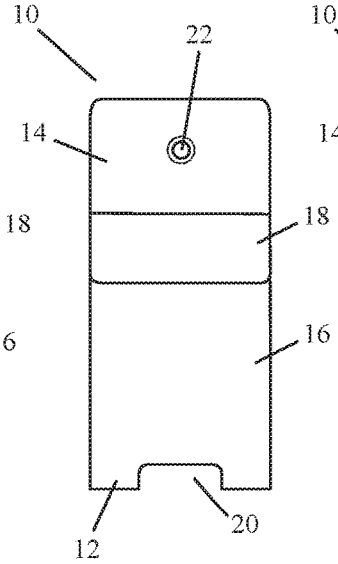
Figure 1C:
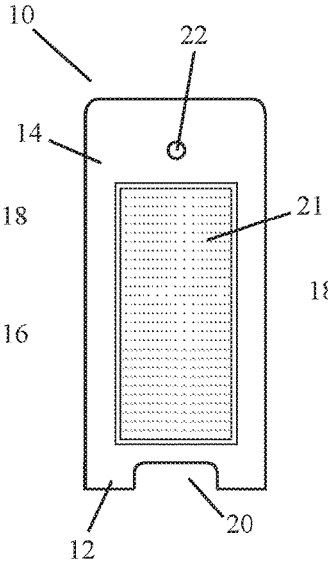
Figure 1D:
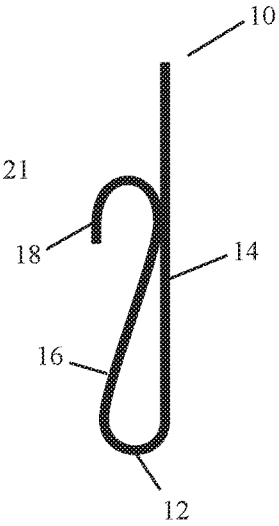
Figure 2:
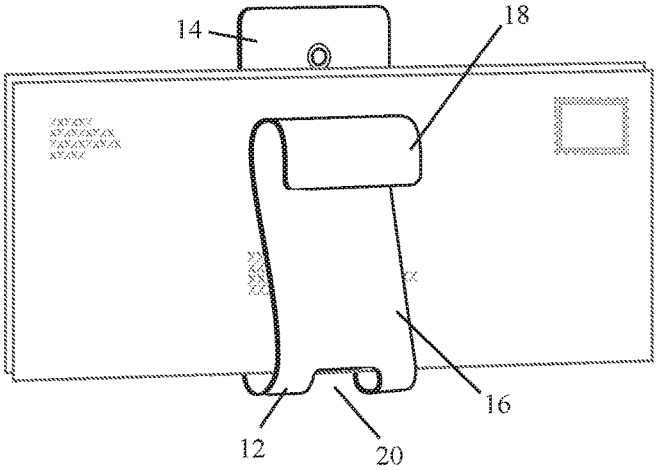
FIG. 2 is a perspective view of the device with mail retaining therein.

Referring to FIGS. 1A-D and 2, in an embodiment a mail retaining system comprises a mail retainer 10. The mail retainer 10 comprises a first portion 14, a second portion 16 and a base 12. The base 12 supports an underside edge of retained mail, as indicated in FIG. 2. The first portion 14 and the second portion 16 extend upwardly from the base 12 and face each other. The second portion 16 is arranged to press retained mail against the first portion 14.

The mail retainer 10 is shaped so that retained mail is visible from a distance, for example 20 m. This means that a person or smart object can determine whether it is necessary to travel to the mail retainer 10 to remove and/or add mail, or if the journey is unnecessary as no mail is there.

The mail retainer 10 further may comprise a pull portion 18. The pull portion 18 may be pulled by a user to pull the second portion 16 away from the first portion 14, thereby to enable retained mail to be located in and/or removed from the mail retainer 10. Alternatively, the mail retainer may also comprise one or more push portions. The one or more push portions may be pushed by a user to pull the second portion away from the first portion, thereby to enable retained mail to be located in and/or removed from the mail retainer. Embodiments of the invention are not limited to any particular way that the second portion 18 is moved relative to the first portion 16.

The base 12, the first portion 14, the second portion 16 and the pull portion 18 are formed of a single piece of metal, for example steel or aluminium. Alternatively, the single piece may be formed of a non-metal material such as a suitable acrylic material. Since the material may be exposed to sunlight for long periods, the material is preferably tolerant to sunlight and/or heat without discolouring or becoming too hot to be comfortable to touch. The mail retainer 10 may have rounded edges and/or rounded corners to prevent a person being poked or scratched through interaction with the device.

The mail retainer 10 may be formed from a flat single piece of material by bending of the piece when softened by heating to form the base 12, the first portion 14, the second portion 16 and the pull portion 18. The material is resiliently deformable at normal use temperatures and is formed such that the second portion 16 presses retained mail against the first portion 14 so that retained mail is held between the first and second portions 14, 16. Additionally, the mail retainer may be formed with or without use of heat, depending upon the material used.

Alternatively, the base 12, the first portion 14, the second portion 16 and the pull portion 18 may be formed of more than one piece of material that are attached together, for example by welding, or with an adhesive or otherwise. The pieces may be formed of pieces shaped to engage together.

The pull portion 18 may be used to pull the second portion 16 away from an initial position pressing against retained mail (or the first portion 14 if no mail is present). When the pull portion 18 is released, the second portion 16 resiles back to the initial position due to the resilient nature of the material and/or how the material is processed in the making of the retainer.

Although not essential, the base 12 has a cutout 20 therein. The cutout prevents build-up of dirt on the base 12 and, where the mail retainer 10 is located outdoors, build-up of water or snow. The cutout also facilitates flexing of the second portion 18 relative to the first portion 16.

The mail retaining device includes attachment means to attach the mail retainer 10 to a fixed vertical mounting surface. The attachment means comprise at least first and second attachment parts. The first attachment part is attached to the first portion 14 and the second attachment part is attachable to a fixed vertical surface, for example that of a door, door frame, wall, post or tree.

The first attachment is in the form of a first attachment material 21 on a side of the first portion 14 opposite the side that retained mail is pressed against. The second part is in the form of a second attachment material (not shown). The first attachment material 21 is configured to detachably attach to the second attachment material. The first portion 14 is preferably planar to facilitate attachment.

The first and second attachment materials may be hook and loop materials (i.e. Velcro®), and/or interlocking material (i.e. Dual Lock™), and/or releasable adhesive material (i.e. Command™ trips), and/or adhesive, etc. The first and second attachment materials may be other kinds of materials that detachably attach. Where the first and second attachment materials are hook and loop materials, the side of the first portion 14 on which the first attachment material 21 is located may be recessed, so that the first attachment material 21 can be at least partially inset into the first portion 14. In variant embodiments where other forms of attachment means are used, for example magnets, the side of the first portion 14 may be recessed to accommodate, wholly or partially, that other form of attachment means.

Alternatively, the second attachment part may be absent. In this case, the first attachment part is configured to detachably attach to the vertical surface. For example, the first attachment part may in this case be in the form of one or more suction cups, releasable adhesive, and/or other fasteners, or, where the vertical surface permits, magnets.

In variant embodiments, the attachment means does not enable the mail retainer to be detached from the vertical surface. The mail retainer can be attached with one or more screws or nails, for example, one of which may be located in an aperture 22 in the first portion 14. The aperture 22 may be recessed so that mail does not catch on a head of the screw or nail. The mail retainer may, additionally or alternatively, be attached with a permanent glue.

Figure 3A:
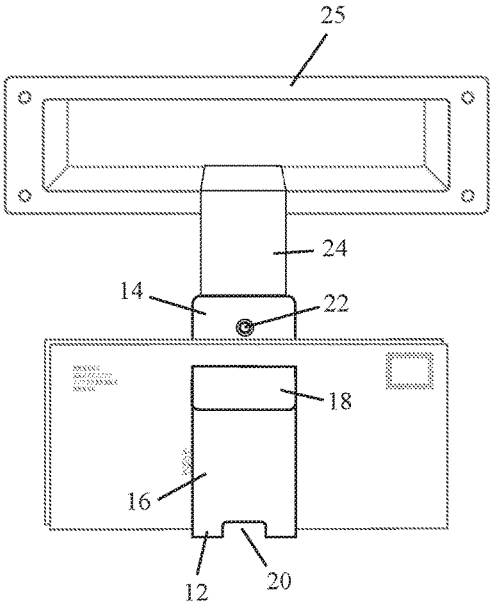
FIG. 3A is a view of the device attached to a door at a first side thereof by a strap extending through a mailing aperture in the door.
Figure 3B:
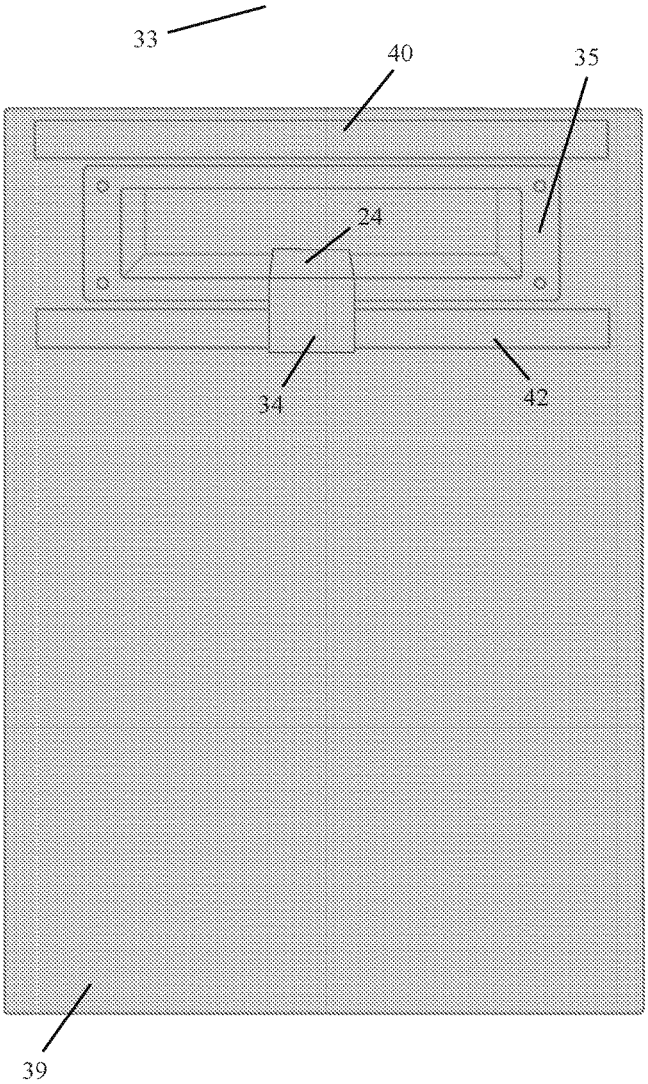
FIG. 3B is a view of a part of the strap that extends through the mailing aperture, and means securing an end of the strap to the second side of the door.

Referring to FIGS. 3A and 3B, in a variant embodiment, the attachment means comprises parts for attaching the mail retainer 10 to a door or wall in which the attachment means includes a strap 24 that extends through a mailing aperture in the door or wall. The attachment means comprises the first attachment part in the form of material 21 fixed to the first portion 14, and the second attachment part (not shown) that is fixedly attached to a first end of the strap 24. The strap 24 extends through the mailing aperture and a second end thereof is detachably secured to a second side of the door using a securing means 34. A first side of the door or wall is typically at an exterior of a property and the second side is at an interior. The strap 24 may be rigid or flexible. Where the strap is rigid, then no connection may be needed to the door or wall and/or to the device.

In a variant embodiment, where the material 21 and the second attachment part are in the form of hook and loop materials, or other detachable materials, two further pieces of said material may be provided, one fixed to the door and the other on a side of the second attachment part opposite to the side that attaches to the material 21 on the first portion 14. This enables the first end of the strap 24 to be attached to the door, as well as to the first portion 14. In this case, mounting on the outside and inside of the door both provide support for the mail retainer 10.

In particular, stability for the mail retainer 10 is usefully added in presence of wind, preventing the mail retainer clanking against the door.

Embodiments of the invention are not limited to use with a mailing aperture in a door; instead the mailing aperture may be in a fixed object such as a wall, for example. Also an aperture through a wall or door with which embodiments may be used need not be limited to being an aperture specifically for mailing. It may be any suitable kind of aperture.

The securing means is in the form of a first attachment piece (not visible) fixed to the second end 34 of the strap 24 and a second attachment piece 42 adhered to the second side 33 of the door. The second end 34 of the strap 24 may be fixed to the first attachment piece, for instance by stitching. Alternatively, the second end 34 of the strap 24 may be otherwise fixed to the first attachment piece, for example by an adhesive. Although not essential, preferably the second attachment piece is adhered beneath the mailing aperture 25 on the door.

The first and second attachment pieces may comprise detachable materials, for example hook and loop (i.e. Velcro®), interlocking materials (i.e. Dual Lock™), releasable adhesive (i.e. Command™ strips), and/or other detachable fasteners, enabling the first and second attachment pieces to be detachably attached. The second attachment piece 42 may be provided with a backing layer located on the adhesive layer, which can be peeled off by the user so that the second attachment piece 42 can be adhered to the second side of the door.

In variant embodiments, the second end of the strap 24 may be otherwise detachably secured to the second side of the door. For example, one of the first and second attachment pieces may be a hook and the other may be a loop for attaching to the hook. One may be affixed to the second end of the strap 24 and the other to the second side 33 of the door. In other variant embodiments, the securing means need not result in the strap 24 being detachably attachable, but instead the securing means may fix the second end of the strap 24 to the second side 33 of the door. For example, the second end of the strap 24 may be screwed, nailed or adhered to the second side 33 of the door.

The strap 24 extends from the securing means through the mailing aperture 25 in the door or wall to the mail retainer 10 on the first side of the door. The strap 24 may be any form of any line or thin sheet of material that can extend through the mailing aperture 25 without obstructing it.

In variant embodiments, the attachment means does not enable the strap 24 to be detached from the mail retainer 10. Instead, the first end of the strap 24 is fixedly attached to the first portion 14, for example by a permanent adhesive.

The mail retainer 10 hangs from the first end of the strap 24 in use, where the mail retainer 10 is not attached additionally to the first side of the door. Since the mail retainer 10 has a symmetrical configuration, the mail retainer 10 hangs vertically with the base 12 at the bottom. Where the mail retainer 10 is attached to the first side of the door, the strap 24 provides support for the mail retainer 10.

Retained mail may be located in the mail retainer 10 for collection. To do this, the pull portion 18 is pulled so that the second portion 16 is moved away from the first portion 14 (or any mail that is already retained). Mail is then located in the mail retainer 10 supported by the base 12. Release of the pull portion 18 allows the second portion 16 to move to press against the retained mail. A person or a smart object collecting the mail may remove the mail from the mail retainer 10 in a similar way. Alternatively, to locate mail in the mail retainer 10, a user may push the mail between the first and second portions 14, 16, which pushes the second portion 16 away from the first portion 14. To remove the mail, a person or smart object may pull the mail from between the first portion 14 and the second portion 16, which allows the second portion 16 to move towards the first portion 14.

Figure 8A:
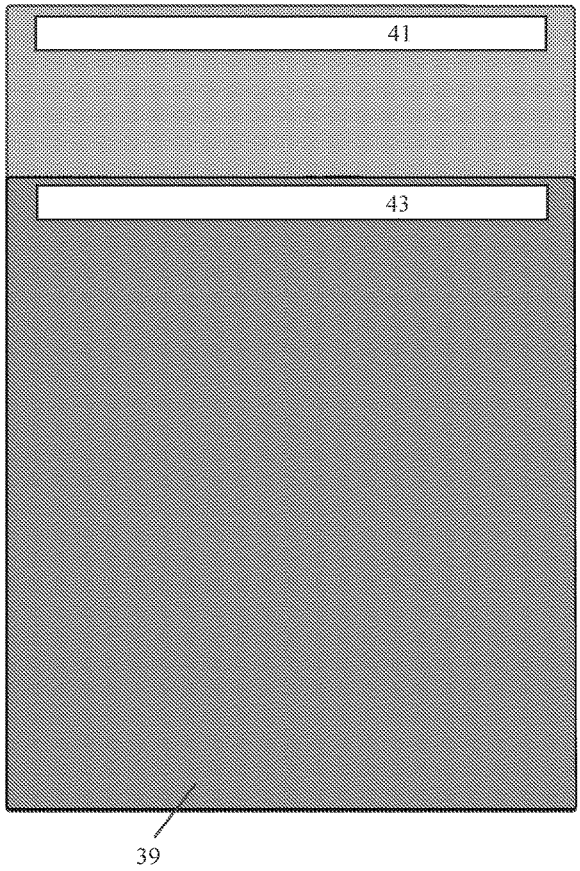
FIGS. 8A and 8B are views of a mail catcher, to which the device may attach.
Figure 8B:
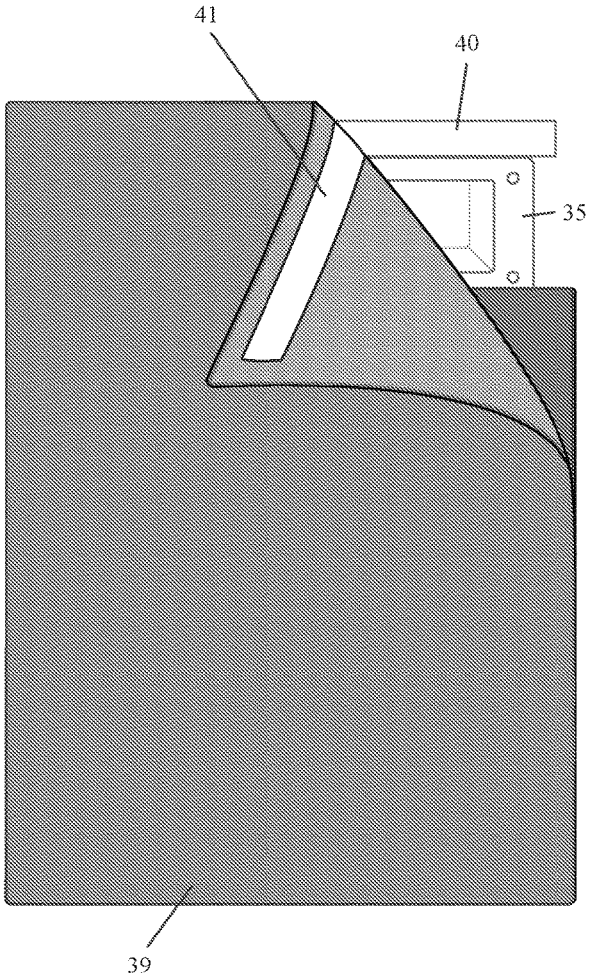

The mail retaining device may be used in conjunction with a variety of devices intended for catching mail. For example, one type of mail catcher is shown in FIGS. 8A and 8B and partially in FIG. 3B. This particular mail catcher comprises a rectangular piece of material 39 and upper and lower strips 40, 42 of hook and loop material, which are attached horizontally above and below the mailing aperture 35 by an adhesive, on the second (interior) side of a door or wall. The piece of material 39 is indicated translucently in FIG. 3B so that the upper and lower strips can be seen. The mail catcher also comprises first and second edge strips 41, 43 of hook and loop material (omitted in FIG. 3B so that 40 and 42 are visible). The first edge strip 41 extends along a first transverse edge of the rectangular piece of material 39 and detachably attaches to the upper strip 40. The second edge 43 strip extends along a second transverse edge parallel to the first transverse edge and detachably attaches to the lower strip 42. The piece of material hangs from the first and second transverse edge strips. Mail put through the mailing aperture from the other side is caught by the mail catcher, in the hanging piece of material.

The second end of the strap 24 may be configured to cooperate with the mail catcher to attach to a portion of the strip 42 located beneath the mailing aperture. In this case, the portion of the strip 42 serves as the second attachment piece. Although not essential, preferably the first attachment piece has hook and loop material on both sides. The hook and loop material on one side is configured to attach to the lower strip 42 on the door or wall. The hook and loop material on the other side is configured to attach to the strip 43 on the second transverse edge of the mail catcher. Thus, the second end of the strap 24 can be sandwiched between the strip 42 attached to the door or wall, and the strip 43 attached to the transverse edge of the mail catcher. Alternatively, the first attachment piece attaches only to the strip 42 or strip 43. Additionally, if the strap is rigid, then it may not need a connection to the interior side of the door. It may perhaps be able to hang onto the door where the aperture resides without any adhesion or fastening at all. When the mail catcher consists of a cage or other configuration, the strap may hook onto it or connect in another other way to the mail catcher and/or its mounting hardware.

Use of detachable material of the strip 42 and/or strip 43 that is already present on the door due to presence of the mail catcher to attach the strap 24 usefully means that nothing further need be attached to the door in order to facilitate use of the device and strap combination. This may be equally true when using other types of mail catchers.

Figure 4:
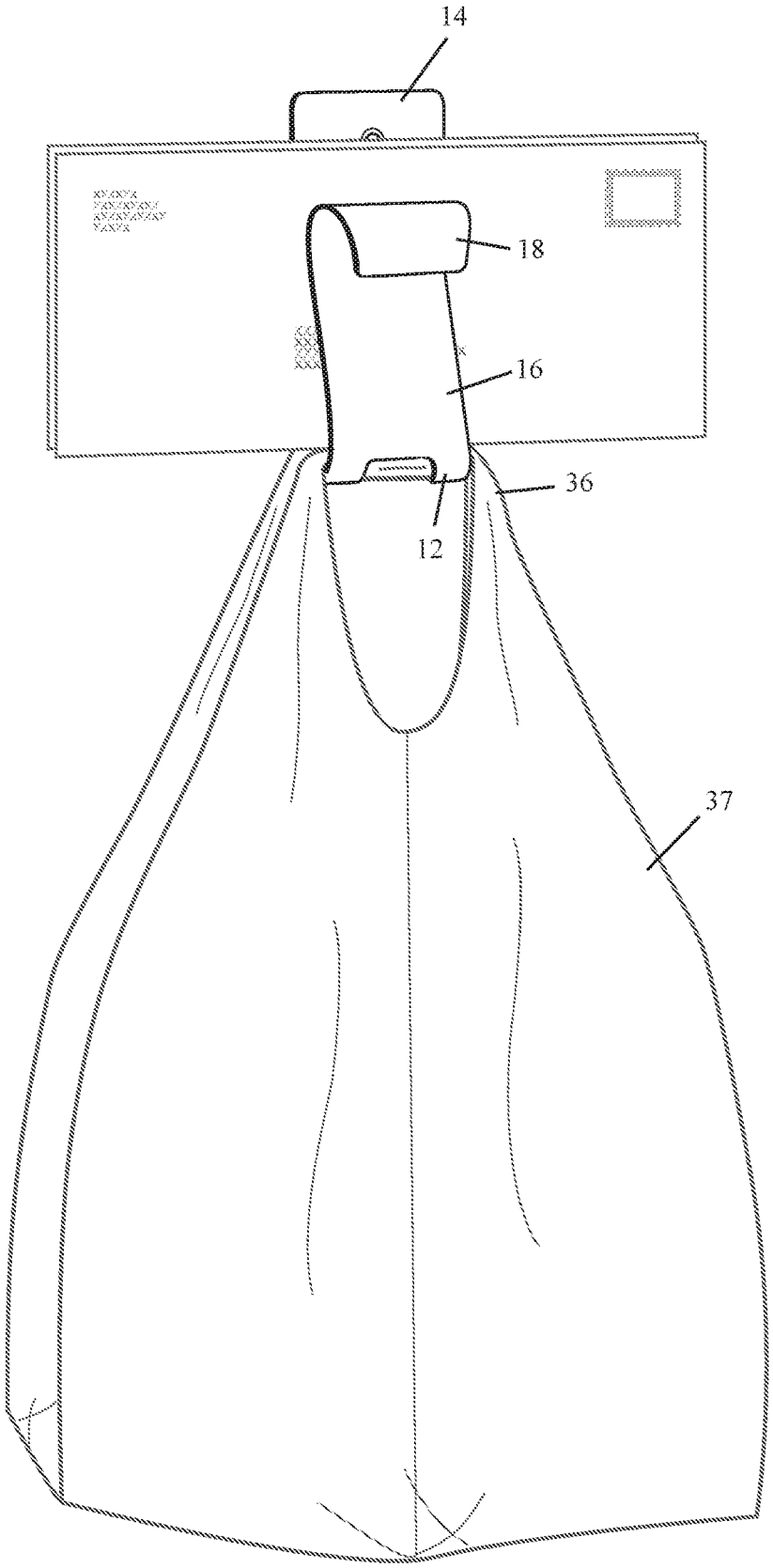
FIG. 4 is a perspective view of the device with a bag hanging from it.

Referring to FIG. 4, to enable larger packages and parcels to be retained by the mail retaining device, a bag 37 can be hung from one or both handles 36 thereof. Larger packages, parcels or additional mail that will not fit in the mail retainer 10 can be located in the bag. Where there is more mail than the mail retainer 10 can accommodate, the excess mail may also be located in the bag.

In embodiments in which attachment to a vertical surface uses detachable materials provided with an adhesive layer and a backing layer, no tools are needed to install the mail retainer.

Figure 5:
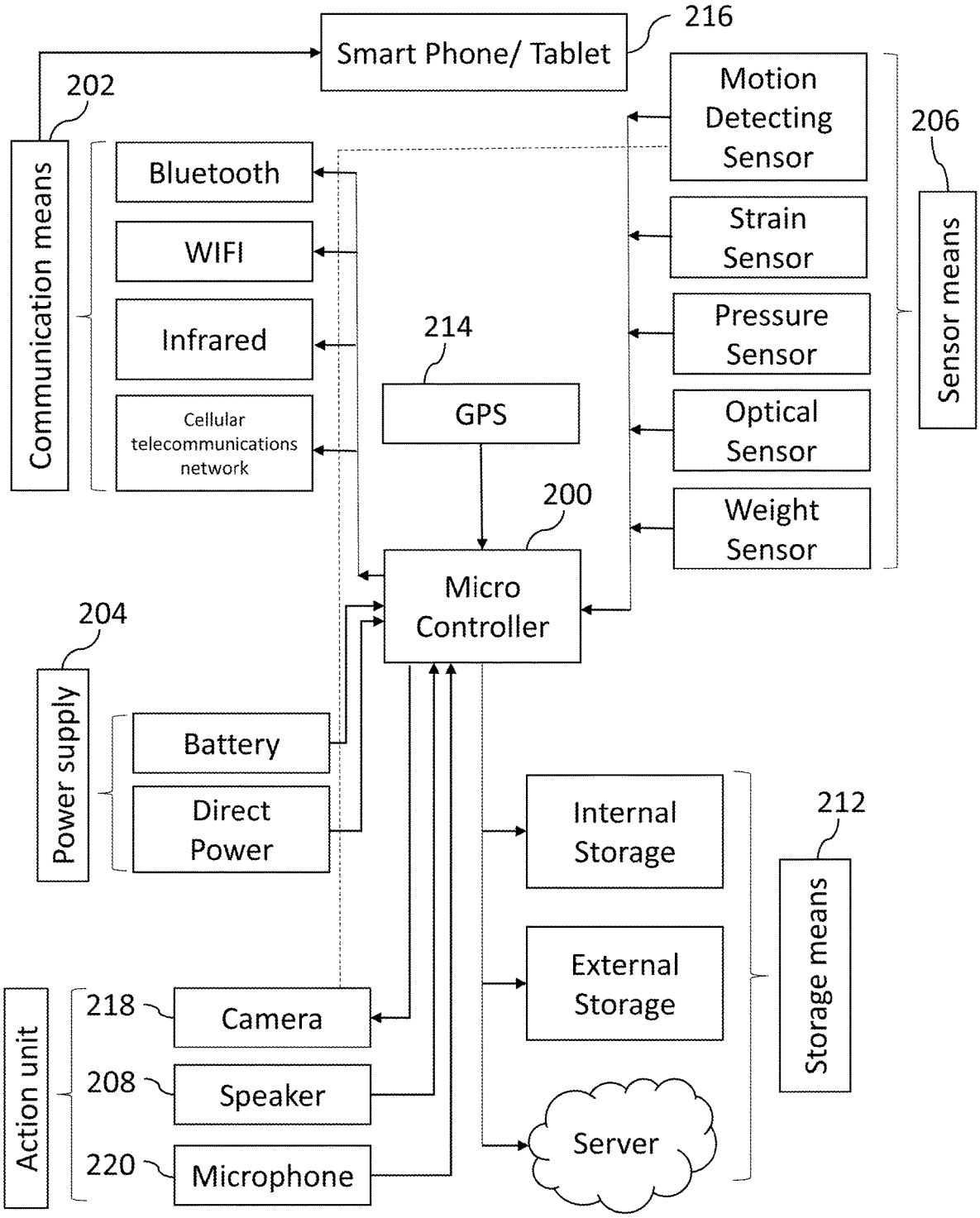
FIG. 5 diagrammatically shows all the components in a system and their respective work flow.

Embodiments are now described with reference to FIG. 5 in which the mail retaining system includes apparatus comprising a sensor 206 that detects when a person and/or a smart object has collected mail or added mail, and an action unit to perform an action in response to determining that the mail has been collected or added.

The apparatus includes a control means in the form of a microcontroller 200, and a power supply 204, a sensor means 206, a communications means 202, speaker 208, camera 218, microphone 220 all operatively connected to the microcontroller 200. The microcontroller 200 is an integrated circuit that includes a processor and a memory. The memory has stored thereon computer program code (e.g., firmware), executable by the processor to cause the functionality associated with the apparatus described herein. The microcontroller 200 is configured to interface with the components coupled to it using one or more physical input or output connections (e.g., pins, or busses). The output behaviour in response to the inputs, such as the signals received from the sensor means 206, is defined by the firmware. The computer program code stored in non-volatile memory of the microcontroller 200 and controls one or more outputs of the microcontroller 200 based upon the one or more inputs. The computer program code, in some examples, is stored in non-volatile memory such as Read-Only Memory (ROM), Electrically Erasable Programmable Read-Only Memory (EEPROM), or the like. While a microcontroller 200 is used herein, one of ordinary skill in the art will appreciate that other types of controller circuitry may be used including an Application Specific Integrated Circuit (ASIC), or the like.

The sensor means 206 is configured to produce a signal indicative of mail having been removed from and/or added to and/or motion in the vicinity of the mail retainer 10, which is provided to and received by the microcontroller 200. The sensor means 206 may be configured directly to respond to the presence of and/or absence of mail in the mail retainer 10. Alternatively, since removal of mail may result in movement of the second portion 16 relative to the first portion 14, the sensor means 206 may be configured to produce the signal in response to such movement. The second portion 16 may also move relative to the first portion when mail is placed in the mail retainer 10. The sensor means 206 may also produce a signal when mail is placed into the mail retainer 10 that cannot be distinguished from a signal when mail is removed, which, in some embodiments at least, this is not problematic.

In an embodiment, the sensor means 206 is in the form of a pressure sensor. The pressure sensor may be located on the base 12 to detect weight of mail on the pressure sensor. Additionally or alternatively, the pressure sensor may be located on the first portion 14 in a position such that, when mail is located in the mail retainer, the mail is pressed by the second portion 16 against the first portion 14, and when mail is not located in the mail retainer 10, the second portion 16 does not press against the pressure sensor. Thus, the pressure sensor is located and configured to provide a signal to the microcontroller 200 indicative of presence and/or absence of mail in the mail retainer 10. Alternatively, the pressure sensor may be mounted on the second portion 16, such that a presence and/or absence of mail is detected.

In another embodiment, the sensor means 206 is in the form of an optical sensor. The optical sensor is located and configured to produce a signal for the microcontroller 200 indicative of when mail is present and/or absent.

A load sensor may be located and configured to produce a signal for the microcontroller 200 indicative of the bag 37 attached to the base 12 of the mail retainer 10, and optionally indicate the weight of the bag.

Movement of the second portion 16 relative to the first portion 14 involves flexing of the mail retainer 10. In another embodiment, the sensor means 206 may be in the form of a flexing sensor in the form of a strain gauge sensor fixed to a surface portion of the mail retainer 10 that flexes when the second portion 16 moves relative to the first portion 14. The strain gauge sensor is configured to flex with flexing of that surface portion and to consequently provide a signal to the microcontroller 200 indicating when the second portion 16 is moved relative to the first portion 14. The second portion 16 moves when mail is inserted into the mail retainer 10, since the second portion 16 is pushed away from the first portion 14. The second portion 16 moves when mail is pulled out of the mail retainer 10, since the second portion 16 resiles to press against the first portion 14. The second portion 16 may also be moved away from the first portion 14 by a user pulling the pull portion 16, which may be performed during leaving or collection of mail. The strain gauge sensor is configured to provide signals to the microcontroller 200 when the second portion 16 is caused to move away from the first portion 14 and/or the second portion 16 moves towards the first portion 14. Thus the strain gauge sensor is located and configured to produce signals for the microcontroller 200 in response to flex of the mail retainer when mail is removed and may also provide signals when mail is added. The strain gauge sensor may be embedded, partially or wholly, in the mail retainer 10. Other gauge of sensor that respond to flex are known in the art and may be used in place of a strain gauge sensor.

In another embodiment, the sensor means 206 may be a type of sensor that determines when the second portion 16 is in a position pressed directly against the first portion 14 and/or when the second portion is in a position spaced from the first portion 14. The second portion is spaced from the first portion 14 when mail is located therebetween. For example, in this case the sensor means 206 may be an optical sensor configured to determine whether the first portion 14 and the second portion 16 are spaced by reference to the position of a part of the second portion 16.

In another embodiment, the sensor means 206 may be an accelerometer attached to the second portion 16. This may be configured to produce a signal indicative of movement of the second portion 16 relative to the first sensor 14 in either one and/or both directions.

Embodiments of the invention are not limited to any particular kind of sensor means 206, provided that the sensor is such as to indicate that mail has been removed and/or added and/or motion has occurred within the vicinity of the device.

Also, in some of the above described embodiments, the sensor means 206 may be configured to provide no signal when mail is present and a signal, for example periodically, when mail is absent, or vice versa. In this case, no signal should be considered to be a signal since information is conveyed by the absence of signal.

In embodiments, the sensor means 206 is in the form of a motion detector, including a camera 218. The motion detector is configured to detect movement of mail and is positioned so that its field of view includes retained mail and/or the area around the device. The motion detector may be located behind the mail, for example in an aperture in or above the first portion 14 behind where mail is located. For example, the motion detector may be located in the aperture 22. When located behind the mail, the camera 218 of the motion detector is oriented to have a field of view such that when mail is located in the mail retainer 10 the field of view of the camera 218 is partially or wholly obstructed by the mail. Where the motion detector 206 is located behind where mail is retained, removal and/or addition of mail may be detected, for example, by a rapid change in light levels. Alternatively, the camera 218 may be otherwise positioned such that the mail, and/or area around the mail retainer, is in the field of view of the camera 218, for example mounted on the second portion 16 or in the base 12. In variant embodiments, the camera 218 may be mounted on an arm extending from the mail retainer 10. The motion detector may be located so that, when mail is located in the mail retainer, a person or a smart object collecting mail cannot see it.

Alternatively, the motion detector may be positioned to detect collection of mail by detecting a person or a smart object removing mail, that is, where the field of view of its camera would include a person or a smart object collecting mail. Leaving of mail may additionally or alternatively be detected. The motion detector is preferably configured to determine that mail has been collected or left only when there is significant motion close enough to the camera 218 that it is likely that a person or a smart object has left or collected mail.

The microcontroller 200 is configured to cause the camera 218 to perform an action in response to receiving a signal from the sensor 206 indicative of the mail having been removed, added, or a person or a smart object being in vicinity of the device. Alternatively, the camera may be engaged without use of a sensor so as to record at continuous intervals as indicated by the user.

Figure 6:
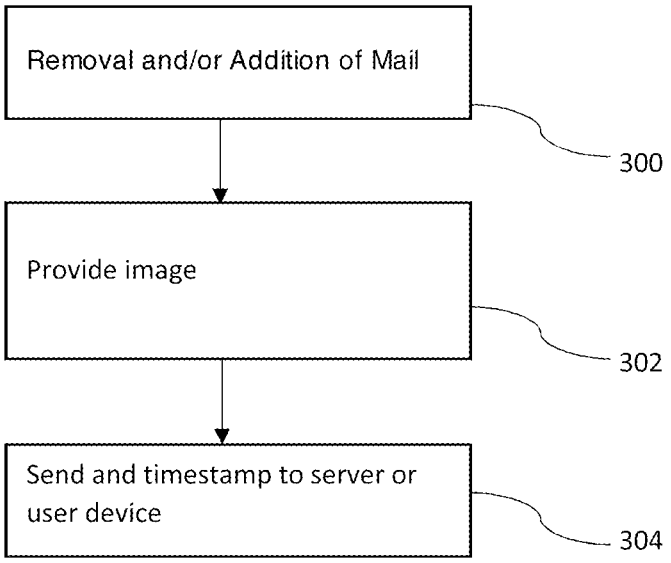
FIG. 6 is a flowchart indicating steps in a process of capturing an image of a person or smart object collecting mail.
Figure 7:
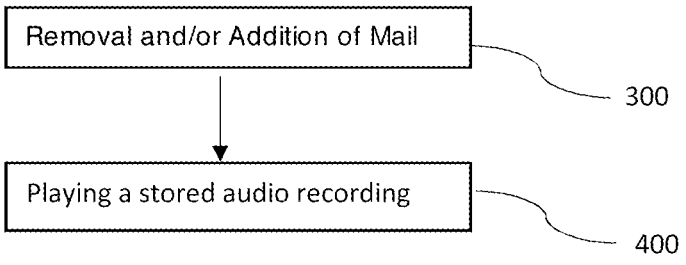
FIG. 7 is a flowchart indicating steps in a process of detecting the mail collection and playing a stored audio recording.

Referring to FIG. 6, in accordance with embodiments described above the sensor means 206 responds to removal of mail from the mail retainer at step 300 by providing a signal to the microcontroller 200 indicative of the mail having been removed. In some embodiments, as already mentioned, the signal may indicate that mail has been added and/or removed and/or that a person or a smart object is within vicinity of the device. At step 302, in response to the signal, the microcontroller 200 causes at least one action to be performed, including an action by the camera 218.

The at least one action may include capturing an image of the person or smart object removing and/or adding mail and/or within vicinity of the device. The at least one action may also include an action relating to the captured image, such as sending and/or storing the captured image by the microcontroller 200. Alternatively, the at least one action may also include an action relating to live streaming and/or continuous recording. In this case, the camera 218, which is positioned such that its field of view includes a person or a smart object removing mail from and/or adding mail to the mail retainer 10 or within vicinity to the device. The microcontroller 206 is configured to cause the camera 218 to capture an image of the person or smart object in response to receiving a signal indicating that mail has been removed and/or added and/or that movement has occurred at or near the device. The camera 218 then provides the captured image to the microcontroller 200 with an associated timestamp. The microcontroller 200 is configured to then send the captured image and timestamp using the communication means 202, and/or to store the captured image in any of the storage means 212. A video clip (with or without audio) may be captured instead of a still image, which comprises multiple images.

Preferably, the communication means 202 is configured for Wi-Fi communication. In this case, a Wi-Fi router is located within range so that images and/or videos can be sent via this Wi-Fi router. Alternatively, the communication means 202 may be configured for sending over Bluetooth® to a local user device, or another communications technology. The communication means 202 may be configured for sending over Infrared to a local user device, or another communications technology. The communication means 202 may be configured for communications via a cellular communications network. The microcontroller 200 may be configured to send captured images and/or videos to a cloud-based server from which the captured images and/or videos can be later retrieved, or to a user device such as a smart phone or other electronic device 216.

In a variant embodiment, additionally or alternatively, the apparatus includes a port (not shown) and the storage means 212. The microcontroller 200, instead of or as well as causing the communications unit 202 to send captured images and/or videos, stores the images and/or videos in the storage means 212. A user can then transfer the captured content from the storage means 212 to a separate user device, such as a personal computer, laptop, tablet, smartphone, or other electronic device or smart device by means of a cable attached to the port. For example, the port may be a USB port.

In some embodiments, the sensor means 206 may be a motion detector and the functionality of the camera 218 of the motion detector and the camera 218 may be combined. In one such embodiment, the camera 218 may be positioned such that its field of view is obstructed by mail when mail is located in the mail retainer 10, but, when mail is removed, the person or a smart object removing the mail is within its field of view. Thus, the motion sensor thus detects when mail has been removed, as described above, and captures an image and/or video of the person or smart object collecting the mail after the mail has been removed. In this case, the camera 218 may be located in a recess in the first portion 14, for example the aperture 22, or elsewhere for example above and/or below the first portion 14.

In another such embodiment, the camera 218 may be positioned to detect when mail is removed by detecting a person or a smart object close to the mail retainer, as described above. In this case, after detection an image and/or video (with or without audio) of the person or smart object may be taken by the camera 218. Alternatively, an image and/or video processed by the motion detector in detecting that mail has been added and/or removed may be provided to the microcontroller 200.

The field of view of the camera 218 may include a person or a smart object removing and/or adding mail to the mail retainer 10. It is to be noted that the field of view of the camera 218 may include both the mail and the person or smart object adding or removing mail, in which case removal or addition of mail may be observed based on a part of the captured images and/or videos.

Where an image and/or video processed by the motion detector in detecting that mail has been removed is provided to the microcontroller 200, the detecting that a person or a smart object has been close to the mail retainer may be determined in the motion detector. The at least one action may comprise providing the image and/or video to the microcontroller 200. Alternatively or additionally, the at least one action may comprise the microcontroller 200 sending the captured imagery using the communication means 202 and/or storing the captured image in any of the storage means 212. A processing unit of the motion detector and the microcontroller may be integrated.

In another embodiment the action comprises, additionally or alternatively to capturing an image and/or video, playing a stored message to the person or smart object collecting the mail and/or in vicinity to the mail retainer. In this case the action unit comprises a speaker 208, a user control and a microphone 220, all operatively connected to the microcontroller 200. The microcontroller 200 is configured to cause the speaker to play a message stored in the storage means 212 using the speaker 208, in response to receiving a signal from the sensor means 206 indicating that mail has been removed and/or added.

The microphone 220 is configured to enable a user to record a reprogrammable message to be played to the person or smart object collecting and/or delivering the mail and the user control is operable by the user, to record a message. For example, the user control may be operable to enable recording of a message and playing of the message to check what has been recorded. The user control may be in the form of a button and audio may be recorded by pressing the button. The same button may be operated to play the message; for example the button may be quickly depressed to play the message and pressed for at least three seconds to enable recording. Alternatively, a three-position switch may be provided for the same functionality, for example.

In a variant embodiment, the microphone 220 and user control may be absent from the system and the message may be recorded using a separate microphone, for example in a smartphone 216 or attached to a computer, and an audio file containing a message thus generated and stored. The file can then be transferred to a storage means 212 of the microcontroller 200. For example, the apparatus may include the communication means 202, in which case the audio file may be provided to the microcontroller 200 over Wi-Fi and stored on the storage means 212 or by means of a wired connection using the port.

Alternatively, the action unit may comprise a display coupled to the microcontroller 200 and a video (with or without audio) may be stored on the storage means 212. In this case, the at least one action comprises playing the stored video.

Embodiments are not limited to any particular kind of action unit. In variant embodiments, the action unit may be in the form of a remote light or sounding device, which the microcontroller causes to light or sound by sending an instruction using the communications unit when it receives a signal indicating that the mail has been added and/or removed or that a person or smart object is within vicinity of the device. Additionally, the system may be used for the blind or deaf (lights instead of sound or sound instead of something visual). If the video recordings also capture audio, such recordings may also provide audible indications to the blind when movement at or near the device, or mail removal and/or addition, has taken place and/or may hear an audio recording by the mail carrier if they leave a message.

In many embodiments of the invention that include a sensor means 206 for detecting that mail has been removed and/or added, it should be clearly understood that the mail retainer need not be the specific design of mail retainer described above. Such a sensor means 206 could instead be used with other kinds of mail retainer, for example a retainer in which the second portion 16 does not press against a first portion 14. Such a mail retainer may be in the form of a box or other container for retaining mail, preferably one that can be fixedly or detachably mounted on a vertical mounting surface. Also embodiments are not limited to where mail is to be retained. Other items, particularly planar items, may be located in the retainer, box or other container. Embodiments of the invention that include a sensor for detecting that mail has been removed may be adapted to detect that mail has been added. In response thereto, the microcontroller 200 may cause at least one action to be performed, for example capturing an image of the person or smart object leaving the mail, and/or playing a message, and/or causing a sound notification, for example.

As will be appreciated by the person skilled in the art, various modifications may be made to the embodiments described above. For example, the first attachment part may be attached to the base 12 rather than to the first portion 14.

In another embodiment, an electronic device (216) may be used individually or part of a smart home and/or smart office system and/or network of devices with integrated software application that allows users to monitor the mail activities of the retainer. A system may be provided comprising a plurality of mail retainers, as described above, and mail activities in an office environment monitored. A video capture device may be continuously monitoring activity around the retainer.

Reference is made above to "hook and loop" material or any material with detachable function. As will be appreciated, where such material is stated as being arranged to detachably attach to other such material, it will be understood that hook material attaches to loop material and the material should be arranged accordingly.

The applicant hereby discloses in isolation each individual feature or step described herein and any combination of two or more such features, to the extent that such features or steps or combinations of features and/or steps are capable of being carried out based on the present specification as a whole in the light of the common general knowledge of a person skilled in the art, irrespective of whether such features or steps or combinations of features and/or steps solve any problems disclosed herein, and without limitation to the scope of the claims.

The invention claimed is:

1. A device comprising:

a retainer for retaining planar items comprising first portion, second portion, and a base, the first portion and the second portion attached to the base, a respective edge of each item being locatable on the base between the first portion and second portion, the second portion being arranged to press respective sides of the retained items against the first portion and to be moveable away from the first portion to release the retained items; and an attaching device for attaching the retainer to a fixed object, the attaching device comprising a strap arranged such that the retainer is coupled to the attaching device from the fixed object.

2. The device of claim 1, wherein the attaching device is for releasably coupling the retainer to the fixed object.

3. The device of claim 1, wherein the first portion, second portion, and the base are formed of a single piece of material, wherein the material is resiliently deformable, such that the second portion is moveable away from the first portion to release the retained items by a flexing of the material.

4. The device of claim 1, wherein:

the retainer further comprises a parting portion extending from the second portion, wherein the parting portion is operable under pressure to flex the second portion away from the first portion.

5. The device of claim 4, wherein the parting portion is formed of a single piece of material.

6. The device of claim 1, wherein the strap comprises a first attachment portion and second attachment portion, wherein the first attachment portion is attachable to the fixed object, the second attachment portion is attached to the first portion or the base, and the first attachment portion and the second attachment portion are arranged to detachably attach together.

7. The device of claim 6, wherein the first attachment portion and the second attachment portion each include hook and loop material enabling attachment and detachment.

8. The device of claim 6, wherein the first attachment portion comprises the strap having a first end and second end, the first end is attachable to the fixed object and the first end is opposite the second end.

9. The device of claim 1, wherein:

the fixed object is a surface having an aperture;

the attaching device is arranged to attach to an interior side of the surface; and the strap is arranged to extend through the aperture, and the retainer is at least partially supported by the strap at an exterior of the surface.

10. The device of claim 1, wherein the retainer is shaped to extend from at least one side of the second portion.

11. The device of claim 10, further comprising at least one motion detection sensor to generate a signal associated with a removal of an item from the retainer.

12. The device of claim 1, further comprising:

at least one sensor device to generate a signal in response to detecting an item removed from the retainer; and a control device for causing at least one action to be performed in response to the signal.

13. The device of claim 12, wherein the sensor device comprises image capture device, and wherein the at least one action includes causing the image capture device to capture image data and to send the image data to a server or user device.

14. The device of claim 12, further comprising a device to output a stored audio message as sound and wherein the at least one action includes causing the output of the sound.

15. An assembly comprising:

a retainer for retaining planar items comprising first portion, second portion, and a base, the first portion and the second portion attached to the base, a respective edge of each item being locatable on the base between the first portion and second portion, the second portion being arranged to press respective sides of the retained items against the first portion and to be moveable away from the first portion to release the retained items;

an attaching device for attaching the retainer to fixed object, the attaching device comprising a strap arranged such that the retainer is coupled to the attaching device from the fixed object; and a bag, wherein the bag has at least one handle, the at least one handle attached to the retainer.

16. The assembly of claim 15, further comprising:

a mail catching means located on a side of the fixed object at which mail is received through a mailing aperture, wherein the mail catching means includes a portion attached to the fixed object to which the attaching means is configured to attach.

* * * * *